US005605379A

United States Patent [19]

Weiss

[11] Patent Number: 5,605,379

[45] Date of Patent: Feb. 25, 1997

[54] CHAIR FOR PROVIDING A STRAIGHT SITTING POSITON

[76] Inventor: Friederike Weiss, Larochegasse 23 A-1130, Vienna, Austria

[21] Appl. No.: 517,665

[22] Filed: Aug. 22, 1995

[30] Foreign Application Priority Data

Aug. 24, 1994 [AT] Austria ..... 263/94

[51] Int. Cl.[6] ..... A47C 7/02

[52] U.S. Cl. ..... 297/452.24; 297/452.25; 297/452.31; 5/652; 5/653

[58] Field of Search ..... 297/452.24, 452.11, 297/452.12, 452.14, 452.25, 452.3, 452.31, 452.32, 452.33, 452.34, 452.36, DIG. 1, DIG. 2; 5/652, 653

[56] References Cited

U.S. PATENT DOCUMENTS

| | | | |
|---|---|---|---|
| 2,667,210 | 1/1954 | Eames | 297/452.24 X |
| 2,970,638 | 2/1961 | Halter | 297/452.25 |
| 3,177,036 | 4/1965 | Halter | 297/452.25 |
| 3,740,096 | 6/1973 | Bridger | 297/452.25 |
| 3,890,004 | 6/1975 | Rail . | |
| 4,500,137 | 2/1985 | Morehouse | 297/452.31 X |
| 4,673,216 | 6/1987 | Alfer . | |
| 5,134,740 | 8/1992 | Summer | 5/652 |
| 5,456,519 | 10/1995 | Davis | 297/452.32 X |
| 5,490,717 | 2/1996 | Greene | 5/654 X |

*Primary Examiner*—Laurie K. Cranmer
*Attorney, Agent, or Firm*—Collard & Roe, P.C.

[57] ABSTRACT

Chair for a straight sitting position of the user with crossed legs (yoga position). The chair as characterized according to the invention has a seat raised on both sides, which is wider towards the front and adapted to the contour of the body resulting from the crossed legs of the user. In the back area of the seat a central elevation is provided which forms an extension of the user's coccyx. The chair's back rest surface has a protrusion located approximately in the area of the fourth and fifth lumbar vertebrae of the user. The seat adapts to the contour of the body which contour results from the crossed legs of the user.

7 Claims, 2 Drawing Sheets

CHAIR FOR PROVIDING A STRAIGHT SITTING POSITON

BACKGROUND OF THE INVENTION

Field of the invention

The invention relates to chairs. More particularly, it relates to a chair which provides the user with a straight sitting position with crossed legs (yoga position).

SUMMARY OF THE INVENTION

The invention comprises a chair formed by a seat or sitting surface and a back rest surface. The sitting surface is raised on both sides. Further the sitting surface is wider at its front area than at its rear area, and is adapted to the contour of the user's body resulting from a crossed leg sitting position. In the back area of the sitting surface, there is provided a central elevation which forms an extension of the user's coccyx.

The back rest surface has a protrusion located approximately in the area of the user's fourth and fifth lumbar vertebrae.

When a person sits in the chair and crosses his/her legs, this creates a completely straight sitting position which frees all energy centers located on the vertebral column and the abdominal area. This straight sitting position is effectively supported by the central elevation of the seat in its rear area, which elevation "forms an extension of the coccyx". Due to the protrusion of the back rest surface in the area of the fourth and fifth lumbar vertebrae, the spine is automatically straightened and stimulated. The raised side parts of the seat laterally support the thighs.

According to further characteristics of the invention, the sitting surface may have indentations in the area of the user's two buttock halves, and may be raised in front. Due to the indentations provided in the area of the two buttock halves, as well as the sitting surface raised in front, forward sliding in the chair is prevented.

According to a preferred embodiment of the invention, the upper rim areas located on the raised side parts of the seat may be shaped outwardly to form arm rests.

According to another characteristic of the invention, the raised side parts of the seat may increase in height towards the back rest surface. This results in arm rests which slope away from the back towards the front, providing relaxation for the muscular system of the arms.

Additionally, to obtain optimal support of the user's thighs, the sitting surface in the area of the thighs may be raised with respect to the rest of the seat. This formation is especially meant for people who have problems bringing their legs into the crossed position.

Finally, it is useful if the seat with its raised side parts and the back rest surface all flow into each other to create a bowl-like seat shape. Such a "bowl-seat shape" is especially advantageous in view of manufacturing low-cost chairs from plastics.

It is therefore an object of the invention to provide a chair which when used over a longer period of time leads to an improvement of the complete supporting apparatus, to a stimulation of the digestive system and to a general improvement of the stomach-intestine tract.

Another object of the invention is to provide a chair for use in the area of psychotherapy and for generally consciousness increasing methods, such as autogenous training, NLP, manager seminars, etc.

It is a further object of the invention to provide a chair that corresponds to the natural positions of many children.

Yet another object of the invention is to provide a chair that offers the possibility for more concentrated and more integrated learning and avoid early childhood changes in the vertebral column due to wrong sitting positions in the school.

Yet another object of the invention is to provide a therapeutic chair which enables less missed work due to illnesses of the body, better decision making through a more centered posture, greater inspirational, creative and total thinking.

It is a further object of the invention to provide a chair which has an improved recreational (recuperational) effect obtained through "easier" relaxation during leisure time activities, such as listening to music, reading, writing and genuine communication. Also, eating while in a healthy sitting position constitutes a recreation for the whole organism.

Still another object of the invention is to provide a chair that has a sitting position which makes possible a centering of body, mind and soul and which stimulates the whole body by activating the lower centers of energy (1st and 2nd chakras).

Still another object of the invention is to provide a chair for people who want to act and live on the basis of such centering in all spheres of life.

It is a further object of the invention to provide a chair that operates reliably and efficiently.

BRIEF DESCRIPTION OF THE DRAWINGS

Other objects and features of the present invention will become apparent from the following detailed description considered in connection with the accompanying drawings, which disclose an embodiment of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF THE PREFERRED EMBODIMENT

Figure 1:
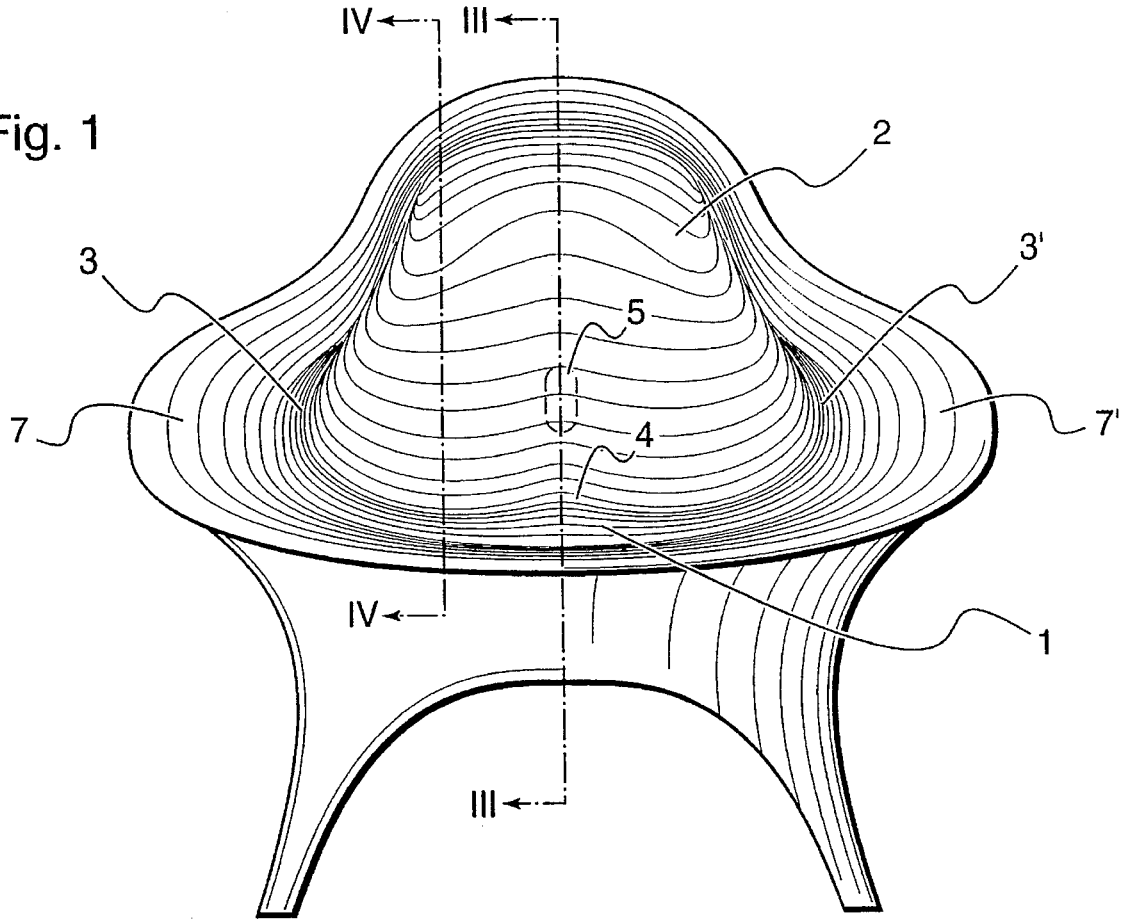
FIG. 1 is a front view of the chair according to the invention.
Figure 2:
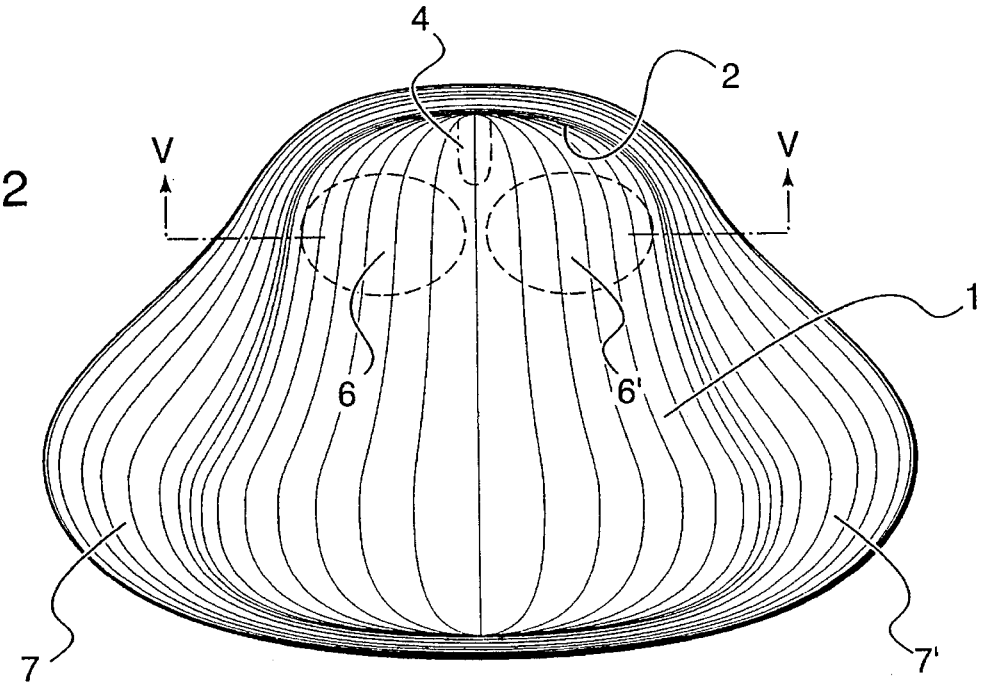
FIG. 2 is a top view of the chair according the invention.

Turning now in detail to the drawings, the chair of the invention shown in FIGS. 1 and 2 may consist of any desired material. Its primary purpose is to provide the user with a straight sitting position with crossed legs, in a seat or sitting surface 1 which widens from the back rest surface 2 towards the front and adapts to the contour of the body resulting from the crossed legs. Seat 1 is laterally raised (at sides 3 and 3') to provide lateral support to the user's thighs. Seat 1 may be raised in the front to prevent a forward sliding of the body in the chair.

Seat 1 has a central elevation portion 4 (as especially shown in FIGS. 1 and 3, and indicated in dotted lines in FIG. 2) in the rear portion thereof, which supports the user's coccyx. This elevation forms an extension of the coccyx or, expressed differently, an artificial vertebrae extension, which adds considerably to the completely straight sitting position desired.

The chair also has a gradually sloping protrusion 5, located in the back rest surface 2 in the approximate area of the user's fourth and fifth lumbar vertebrae. This protrusion 5 automatically straightens and stimulates the spine of the user (see FIG. 3 and as indicated in FIG. 1 in dotted lines).

Figure 4:
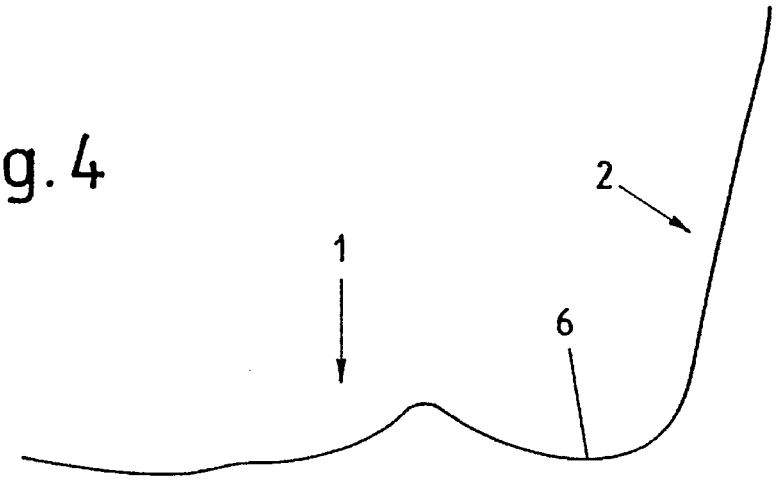
FIG. 4 is a schematic view of the course of sitting and back rest surface along section line IV—IV of FIG. 1.
Figure 5:
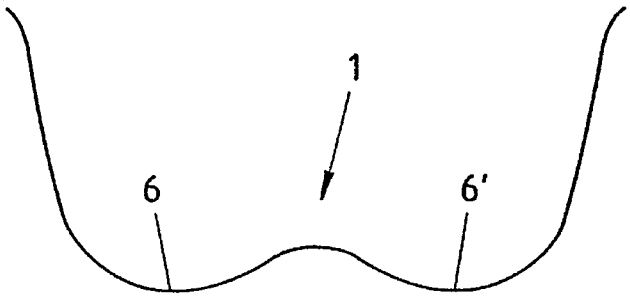
FIG. 5 is a schematic view of the course of sitting surface along section line V—V of FIG. 2.

In a further embodiment of the invention, indentations 6 and 6' are provided in seat 1 in the area of the user's buttock halves, as shown in FIG. 4 and indicated in FIG. 2 by dotted lines. These indentations 6 and 6' prevent forward sliding and keep the body of the user situated in the chair in the correct position with respect to elevation 4 of seat 1 and protrusion 5 of back rest surface 2.

As shown in FIGS. 1 and 2, the upper rim areas of the raised side parts 3 and 3' of seat 1 are shaped outwardly so that arm rest surfaces 7 and 7' are formed, respectively. Since the height of the raised side parts 3 and 3' continually increases towards the back rest surface 2, arm rest surfaces 7 and 7' slope clown towards the front and thereby provide a comfortable arm support at a completely relaxed muscular position of the users arms.

The seat 1 with its raised side parts 3 and 3' and the back rest surface 2, are all integrally formed with each other and flow into each other in a bowl-like manner, giving the user a feeling of security. Also, such a bowl-seat shape, as already mentioned, is advantageous in view of manufacturing low-cost chairs from plastics.

Figure 3:
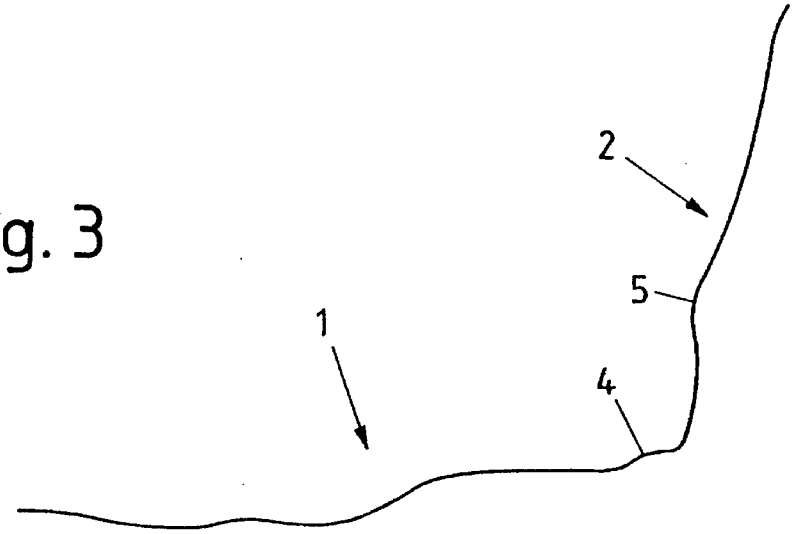
FIG. 3 is a schematic view of the course of sitting and back rest surfaces along section line III—III of FIG. 1.

As evident from FIGS. 3 and 4, seat 1 slopes continuously downward from the back towards the front. Such a formation is essentially meant for people for whom sitting with crossed legs causes no problems. On the other hand, for people who have difficulty bringing their legs into the crossed position and keeping them in that position, seat 1 may be raised in the thigh region to obtain an optimal support of the thighs and to assure good circulation of the legs.

While one embodiment of the present invention has been shown and described, it is to be understood that many changes and modifications may be made thereunto without departing from the spirit and scope of the invention as defined in the appended claims.

I claim:

1. A chair for providing a straight sitting position of a user sitting with crossed legs in yoga position, comprising:

a seat having a sitting surface with a left side part, a right side part, a rear area, and a front area, said left and right side parts being raised for laterally supporting the user's thighs, and said sitting surface being wider at said front area than at said rear area and being adapted to the contour of the user's body resulting from a crossed leg yoga position;

a central elevation integrally formed in the rear area of said sitting surface of said seat, said central elevation adapted to form an extension of the user's coccyx;

a back rest surface connected to said rear area of said sitting surface for providing back support to the user; and a protrusion integrally formed with and disposed on said back rest surface, said protrusion being adapted to contact the user approximately in the area of his fourth and fifth lumbar vertebrae for straightening and stimulating the user's spine.

2. The chair according to claim 1, wherein said sitting surface further comprises a pair of indentations formed into said rear area of said sitting surface, each of said pair of indentations being adapted to receive one of the user's buttocks.

3. The chair according to claim 1, wherein said sitting surface is raised in said front area.

4. The chair according to claim 1, wherein each of said raised left and right side parts of said sitting surface further comprise:

an upper rim area integrally formed with and extending outwardly from said sitting surface to form an armrest surface.

5. The chair according to claim 4, wherein said upper rim areas of said raised side parts of said sitting surface gradually increase in height and extend towards said back rest surface.

6. The chair according to claim 1, wherein said sitting surface has an elevation in the region of the user's thighs.

7. The chair according to claim 1, wherein said sitting surface with its raised side parts and said back rest surface are integrally formed with each other and flow into each other in a bowl-like manner.

* * * * *